US010116058B2

(12) United States Patent
Oh et al.

(10) Patent No.: US 10,116,058 B2
(45) Date of Patent: Oct. 30, 2018

(54) MULTI-APERTURE PLANAR LENS ANTENNA SYSTEM

(71) Applicant: Samsung Electronics Co., Ltd, Suwon-si (KR)

(72) Inventors: Jungsuek Oh, Fairview, TX (US); Jianzhong Zhang, Plano, TX (US)

(73) Assignee: Samsung Electronics Co., Ltd., Suwon-si (KR)

( * ) Notice: Subject to any disclaimer, the term of this patent is extended or adjusted under 35 U.S.C. 154(b) by 277 days.

(21) Appl. No.: 15/006,961

(22) Filed: Jan. 26, 2016

(65) Prior Publication Data

US 2016/0240923 A1 Aug. 18, 2016

Related U.S. Application Data

(60) Provisional application No. 62/115,912, filed on Feb. 13, 2015.

(51) Int. Cl.

| | |
|---|---|
| ***H01Q 15/10*** | (2006.01) |
| ***H01Q 19/06*** | (2006.01) |
| ***H01Q 21/06*** | (2006.01) |

(52) U.S. Cl.

CPC ..... *H01Q 15/10* (2013.01); *H01Q 19/062* (2013.01); *H01Q 21/061* (2013.01)

(58) Field of Classification Search

CPC .... H01Q 15/10; H01Q 19/061; H01Q 19/062; H01Q 21/061; H01Q 21/062; H01Q 15/02

See application file for complete search history.

(56) References Cited

U.S. PATENT DOCUMENTS

| | | | | |
|---|---|---|---|---|
| 2009/0315794 | A1* | 12/2009 | Alamouti | H01Q 1/007 343/753 |
| 2010/0066639 | A1* | 3/2010 | Ngyuen | H01Q 15/08 343/911 R |
| 2012/0076498 | A1 | 3/2012 | Sayeed et al. | |
| 2014/0313090 | A1 | 10/2014 | Oh et al. | |
| 2015/0009080 | A1 | 1/2015 | Oh et al. | |

OTHER PUBLICATIONS

A Programmable Lens-Array Antenna With Monolithically Integrated MEMS Switches, by Chih-Chieh Cheng et al.; IEEE Transactions on Microwave Theory and Techniques, vol. 57, No. 8, Aug. 2009—pp. 1874-1884.

Beam Scanning Using Flat Transformation Electromagnetic Focusing Lenses, by Do-Hoon Kwon et al.; IEEE Antennas and Wireless Propagation Letters, vol. 8, 2009—pp. 1115-1118.

Beamspace MIMO for Millimeter-Wave Communications: System Architecture, Modeling, Analysis, and Measurements, by John Brady et al.; IEEE Transactions on Antennas and Propagation, vol. 61, No. 7, Jul. 2013—pp. 3814-3827.

Enhancing the Directivity of Phased Array Antennas Using Lens-Arrays, by Abbas Abbaspour-Tamijani et al.; Progress in Electromagnetics Research M, vol. 29, 41-64, 2013—24 Pages.

* cited by examiner

*Primary Examiner* — Graham Smith
*Assistant Examiner* — Noel Maldonado

(57) ABSTRACT

A method for operating system. The method includes emitting a plurality of beams and steering the plurality of beams. Each of the plurality of lenses includes a different phase profile. The method further includes transmitting the plurality of beams. Each of the plurality of beams comprises a different beam pattern.

20 Claims, 10 Drawing Sheets

MULTI-APERTURE PLANAR LENS ANTENNA SYSTEM

CROSS-REFERENCE TO RELATED APPLICATION(S) AND CLAIM OF PRIORITY

This application claims priority under 35 U.S.C. § 119(e) to U.S. Provisional Patent Application No. 62/115,912 filed on Feb. 13, 2015. The above-identified provisional patent application is hereby incorporated by reference in its entirety.

TECHNICAL FIELD

This disclosure relates generally to antennas and electromagnetics in wireless communication systems. More specifically, this disclosure relates to multi-aperture planar lens antenna system.

BACKGROUND

A lens is an electronic device that may focus a planar wave front of electro-magnetic (EM) waves to a focal point or, conversely, collimate spherical waves emitting from a point source to plane waves. Such fundamental characteristics are widely used in various applications, such as communication, imaging, radar, and spatial power combining systems. For example, in millimeter-wave frequency bands that fifth generation (5G) communication standards may employ, lenses have been paid considerable attention as a potential solution to overcome limits in gain and beam steering capabilities of antennas operating in such frequency bands.

SUMMARY

This disclosure provides multi-aperture planar lens antenna system.

In one embodiment, an apparatus includes at least one feed subarray of antenna elements and a plurality of lenses in an aperture. The at least one feed subarray of antenna elements is configured to emit a plurality of beams. The plurality of lenses is configured to steer the plurality of beams. Each of the plurality of lenses including a different phase profile.

In another embodiment, a method for operating system is provided. The method includes emitting a plurality of beams, steering the plurality of beams, each of the plurality of lenses including a different phase profile, and transmitting the plurality of beams. Each of the plurality of beams comprising a different beam pattern.

In yet another embodiment, a system includes at least one feed subarray of antenna elements configured to emit a plurality of beams. The system further includes a plurality of lenses in an aperture. The plurality of lenses is configured to steer the plurality of beams. Each of the plurality of lenses includes a different phase profile. The system further includes at least one antenna configured to transmit the plurality of beams. Each of the plurality of beams comprising a different beam pattern.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 16, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged wireless communication system.

The following documents and standards descriptions are hereby incorporated by reference into the present disclosure as if fully set forth herein: Akbar M. Sayeed and Nader Behdad, "HYBRID ANALOG-DIGITAL PHASED MIMO TRANSCEIVER SYSTEM," Pub NO US 2012/0076498 A1, US patent, March 2012. (REF 1), J. Brady, N. Behdad, and A. M. Sayeed, "Beamspace MIMO for millimeter-wave communications: System architecture, modeling, analysis, and measurements," IEEE Trans. Antennas Propag., vol. 61, no. 7, pp. 3814-3827, July 2013. (REF 2), C.-C. Cheng, B. Lakshminarayanan, and A. Abbaspour-Tamijani, "A programmable lens-array antenna with monolithically integrated MEMS switches," IEEE Trans. Microwaves Theory Tech., vol. 57, no. 8, pp. 1874-1884, August 2009. (REF 3), D. H. Kwon and D. H. Werner, "Beam scanning using flat transformation electromagnetic focusing lenses," IEEE Antennas Wireless Propag. Lett., vol. 8, pp. 1115-1118, 2009. (REF 4), A. Abbaspour-Tamijani, L. Zhang and H. K. Pan, "Enhancing the directivity of phased array antennas using lens-arrays," Progress In Electromagnetics Research M, Vol. 29, 41-64, 2013. (REF 5), J. Oh, G. Hutcheson, and W. Hong, "Low-Cost Low-Loss Planar Lens Employing Mixed-Order Cauer/Elliptic Filter," Prosecution ID WD-201304-024-1-USO, April 2013. (REF 6), and J. Oh and G. Hutcheson, "Single-Substrate Planar Lens Employing Spatial Mixed-Order Bandpass Filter," Prosecution ID WD-201307-013-1-USO, July 2013. (REF 7)

Figure 1:
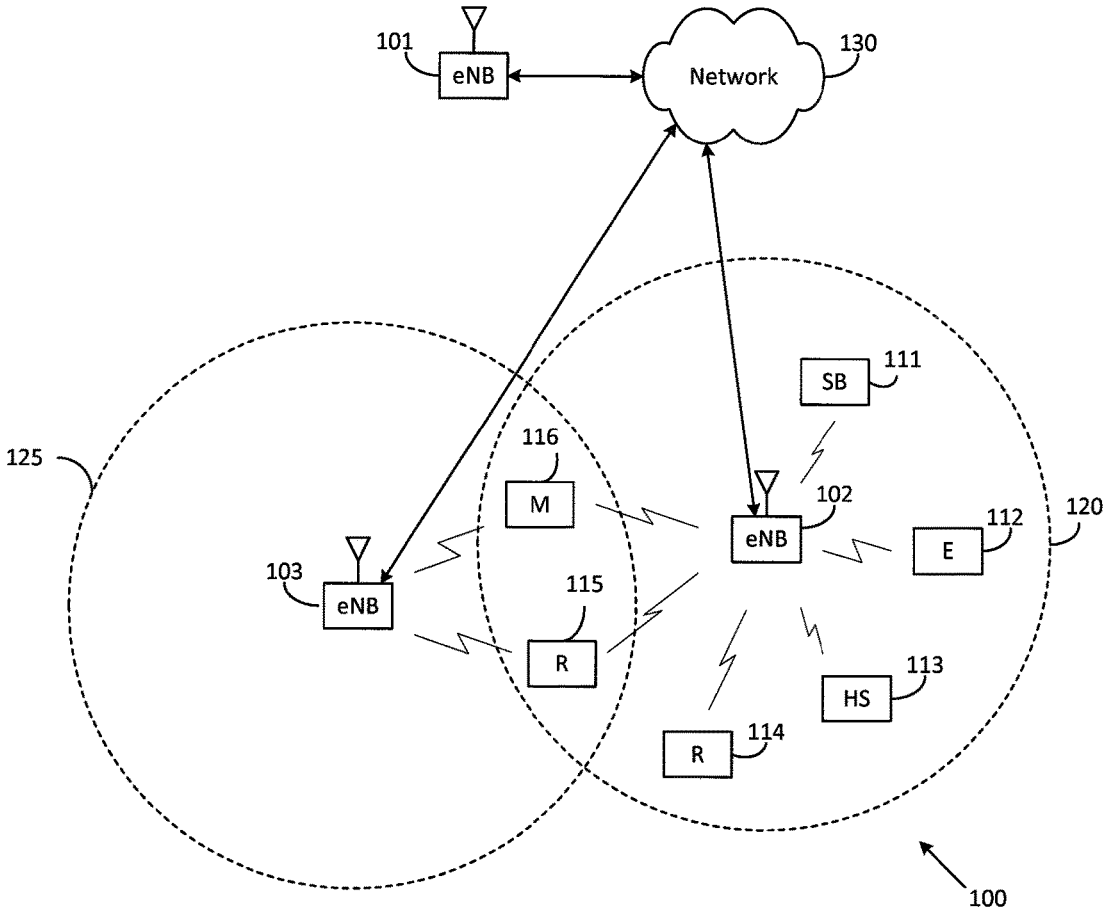
FIG. 1 illustrates an example wireless network according to embodiments of the present disclosure.
Figure 2:
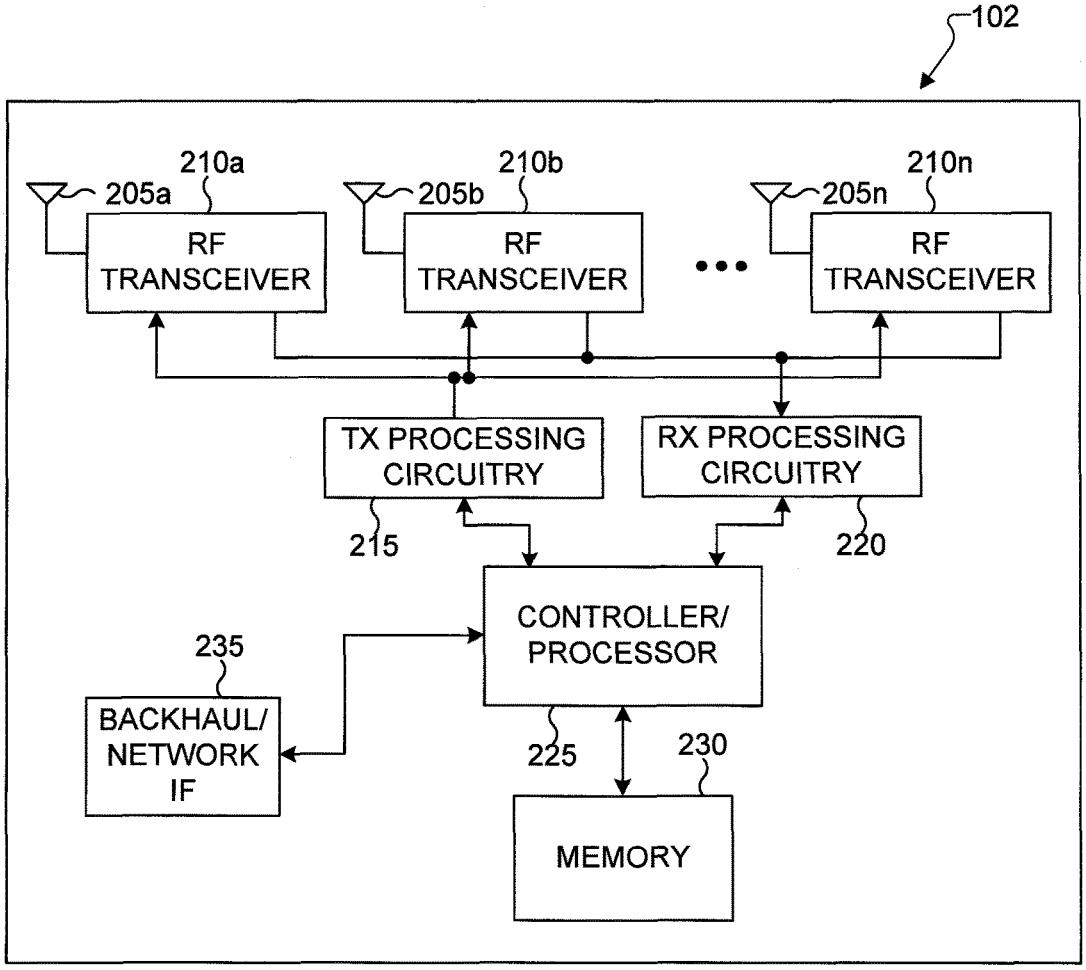
FIG. 2 illustrates an example eNodeB (eNB) according to embodiments of the present disclosure.
Figure 3:
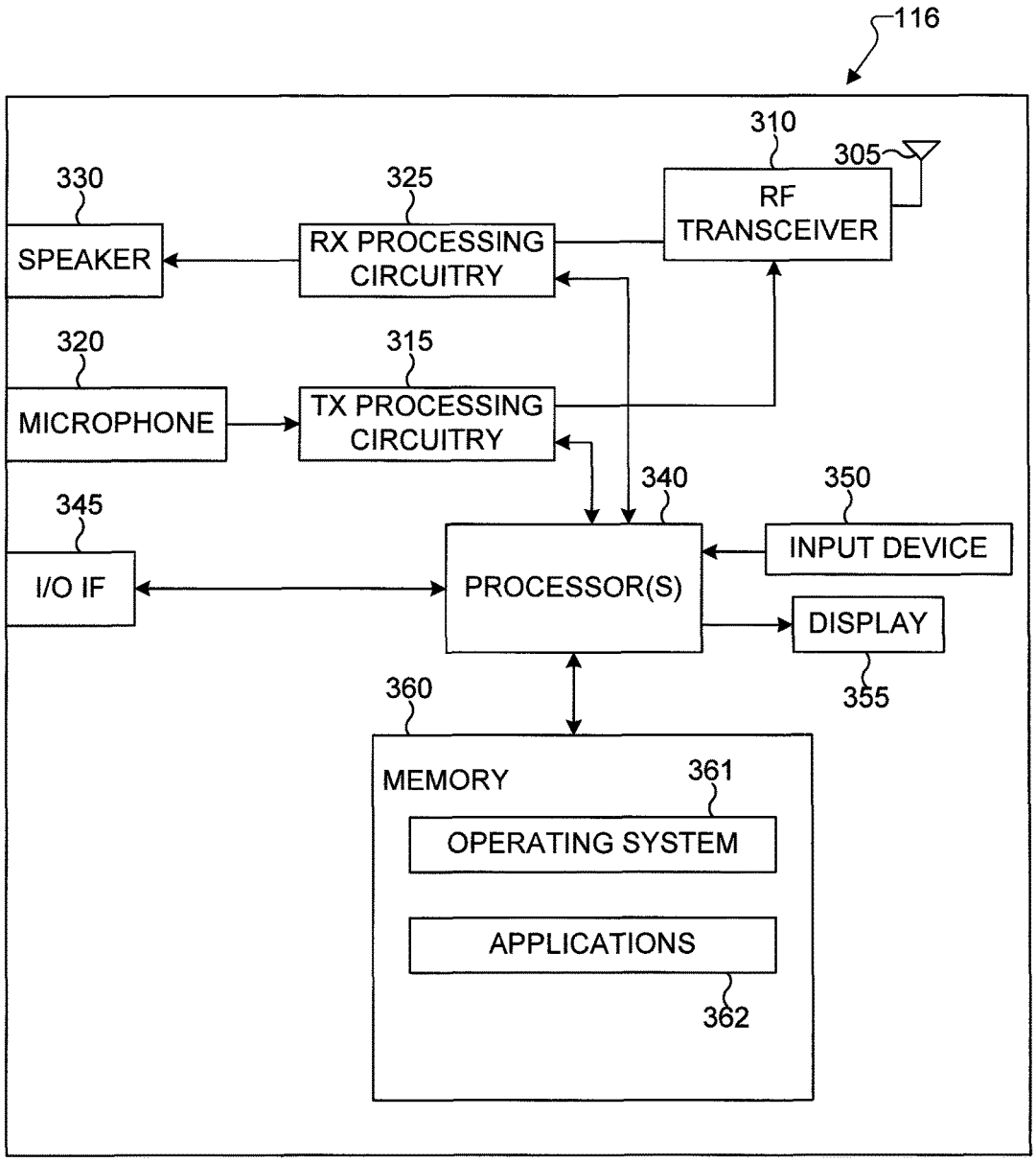
FIG. 3 illustrates an example user equipment (UE) according to embodiments of the present disclosure.

The descriptions of FIGS. 1-3 are not meant to imply physical or architectural limitations to the manner in which different embodiments may be implemented. Different embodiments of the present disclosure may be implemented in any suitably-arranged communications system.

FIG. 1 illustrates an example wireless network 100 according to embodiments of the present disclosure. The embodiment of the wireless network 100 shown in FIG. 1 is for illustration only. Other embodiments of the wireless network 100 could be used without departing from the scope of this disclosure.

As shown in FIG. 1, the wireless network 100 includes an eNB 101, an eNB 102, and an eNB 103. The eNB 101 communicates with the eNB 102 and the eNB 103. The eNB 101 also communicates with at least one network 130, such as the Internet, a proprietary Internet Protocol (IP) network, or other data network.

The eNB 102 provides wireless broadband access to the network 130 for a first plurality of UEs within a coverage area 120 of the eNB 102. The first plurality of UEs includes a UE 111, which may be located in a small business (SB); a UE 112, which may be located in an enterprise (E); a UE 113, which may be located in a WiFi hotspot (HS); a UE 114, which may be located in a first residence (R); a UE 115, which may be located in a second residence (R); and a UE 116, which may be a mobile device (M), such as a cell phone, a wireless laptop, a wireless PDA, or the like. The eNB 103 provides wireless broadband access to the network 130 for a second plurality of UEs within a coverage area 125 of the eNB 103. The second plurality of UEs includes the UE 115 and the UE 116. In some embodiments, one or more of the eNBs 101-103 may communicate with each other and with the UEs 111-116 using 5G, LTE, LTE-A, WiMAX, WiFi, LTE-U(LAA) or other wireless communication techniques.

Depending on the network type, other well-known terms may be used instead of "eNodeB" or "eNB," such as "base station" or "access point." For the sake of convenience, the terms "eNodeB" and "eNB" are used in this patent document to refer to network infrastructure components that provide wireless access to remote terminals. Also, depending on the network type, other well-known terms may be used instead of "user equipment" or "UE," such as "mobile station," "subscriber station," "remote terminal," "wireless terminal," or "user device." For the sake of convenience, the terms "user equipment" and "UE" are used in this patent document to refer to remote wireless equipment that wirelessly accesses an eNB, whether the UE is a mobile device (such as a mobile telephone or smartphone) or is normally considered a stationary device (such as a desktop computer or vending machine).

Dotted lines show the approximate extents of the coverage areas 120 and 125, which are shown as approximately circular for the purposes of illustration and explanation only. It should be clearly understood that the coverage areas associated with eNBs, such as the coverage areas 120 and 125, may have other shapes, including irregular shapes, depending upon the configuration of the eNBs and variations in the radio environment associated with natural and man-made obstructions.

As described in more detail below, one or more of the UEs 111-116 include circuitry, programming, or a combination thereof, for processing of uplink and downlink channels on unlicensed frequency spectrum and/or licensed frequency spectrum using a carrier aggregation scheme. In certain embodiments, and one or more of the eNBs 101-103 includes circuitry, programming, or a combination thereof, for processing beam patterns and angular coverage of planar lens antenna systems by employing multiple lenses and feed arrays.

Although FIG. 1 illustrates one example of a wireless network 100, various changes may be made to FIG. 1. For example, the wireless network 100 could include any number of eNBs and any number of UEs in any suitable arrangement. Also, the eNB 101 could communicate directly with any number of UEs and provide those UEs with wireless broadband access to the network 130. Similarly, each eNB 102-103 could communicate directly with the network 130 and provide UEs with direct wireless broadband access to the network 130. Further, the eNBs 101, 102, and/or 103 could provide access to other or additional external networks, such as external telephone networks or other types of data networks.

In one embodiment, the eNB 101 may communicate with neighbor eNBs using a multi-aperture planar lens antenna system through a wireless communication channel. In another embodiment, the eNB 101 may communicate with a backhaul network using a multi-aperture planar lens antenna system through a wireless communication channel. In such embodiments, the eNB 101 may use multi-aperture lens antenna system comprising multiple lenses and single/multi-sources for wireless communications, where the lens aperture may include at least two different-type lenses, each of which is designed to achieve different angular range.

FIG. 2 illustrates an example eNB 102 according to embodiments of the present disclosure. The embodiment of the eNB 102 illustrated in FIG. 2 is for illustration only, and the eNBs 101 and 103 of FIG. 1 could have the same or similar configuration. However, eNBs come in a wide variety of configurations, and FIG. 2 does not limit the scope of this disclosure to any particular implementation of an eNB.

As shown in FIG. 2, the eNB 102 includes multiple antennas 205*a*-205*n*, multiple RF transceivers 210*a*-210*n*, transmit (TX) processing circuitry 215, and receive (RX) processing circuitry 220. The eNB 102 also includes a controller/processor 225, a memory 230, and a backhaul or network interface 235.

The RF transceivers 210*a*-210*n* receive, from the antennas 205*a*-205*n*, incoming RF signals, such as signals transmitted by UEs in the network 100. The RF transceivers 210*a*-210*n* down-convert the incoming RF signals to generate IF or baseband signals. The IF or baseband signals are sent to the RX processing circuitry 220, which generates processed baseband signals by filtering, decoding, and/or digitizing the baseband or IF signals. The RX processing circuitry 220 transmits the processed baseband signals to the controller/processor 225 for further processing.

The TX processing circuitry 215 receives analog or digital data (such as voice data, web data, e-mail, or interactive video game data) from the controller/processor 225. The TX processing circuitry 215 encodes, multiplexes, and/or digitizes the outgoing baseband data to generate processed baseband or IF signals. The RF transceivers 210*a*-210*n* receive the outgoing processed baseband or IF signals from the TX processing circuitry 215 and up-converts the baseband or IF signals to RF signals that are transmitted via the antennas 205*a*-205*n*.

The controller/processor 225 can include one or more processors or other processing devices that control the overall operation of the eNB 102. For example, the controller/processor 225 could control the reception of forward channel signals and the transmission of reverse channel signals by the RF transceivers 210*a*-210*n*, the RX processing circuitry 220, and the TX processing circuitry 215 in accordance with well-known principles. The controller/processor 225 could support additional functions as well, such as more advanced wireless communication functions. For instance, the controller/processor 225 could support beam forming or directional routing operations in which outgoing signals from multiple antennas 205*a*-205*n* are weighted differently to effectively steer the outgoing signals in a desired direction.

In one embodiment, the multiple antennas 205*a*-205*n* may be implemented by a multi-aperture lens antenna system comprising multiple lenses and multi/single-source for wireless communications. In such embodiment, the lens aperture includes at least two different-type lenses, each of which is designed to achieve different angular range.

Any of a wide variety of other functions could be supported in the eNB 102 by the controller/processor 225. In some embodiments, the controller/processor 225 includes at least one microprocessor or microcontroller. As described in more detail below, the eNB 102 includes circuitry, programming, or a combination thereof for processing beam patterns and angular coverage of planar lens antenna systems by employing multiple lenses and feed arrays.

For example, controller/processor 225 can be configured to execute one or more instructions, stored in memory 230, that are configured to cause the controller/processor to process uplink and downlink channels on unlicensed spectrum and/or licensed spectrum using a carrier aggregation scheme.

The controller/processor 225 is also capable of executing programs and other processes resident in the memory 230, such as an OS. The controller/processor 225 can move data into or out of the memory 230 as required by an executing process.

The controller/processor 225 is also coupled to the backhaul or network interface 235. The backhaul or network interface 235 allows the eNB 102 to communicate with other devices or systems over a backhaul connection or over a network. The interface 235 could support communications over any suitable wired or wireless connection(s). For example, when the eNB 102 is implemented as part of a cellular communication system (such as one supporting 5G, LTE, LTE-A, or LTE-U(LAA)), the interface 235 could allow the eNB 102 to communicate with other eNBs over a wired or wireless backhaul connection. When the eNB 102 is implemented as an access point, the interface 235 could allow the eNB 102 to communicate over a wired or wireless local area network or over a wired or wireless connection to a larger network (such as the Internet). The interface 235 includes any suitable structure supporting communications over a wired or wireless connection, such as an Ethernet or RF transceiver.

The memory 230 is coupled to the controller/processor 225. Part of the memory 230 could include a RAM, and another part of the memory 230 could include a flash memory or other ROM.

Although FIG. 2 illustrates one example of eNB 102, various changes may be made to FIG. 2. For example, the eNB 102 could include any number of each component shown in FIG. 2. As a particular example, an access point could include a number of interfaces 235, and the controller/ processor 225 could support routing functions to route data between different network addresses. As another particular example, while shown as including a single instance of TX processing circuitry 215 and a single instance of RX processing circuitry 220, the eNB 102 could include multiple instances of each (such as one per RF transceiver). Also, various components in FIG. 2 could be combined, further subdivided, or omitted and additional components could be added according to particular needs.

FIG. 3 illustrates an example UE 116 according to embodiments of the present disclosure. The embodiment of the UE 116 illustrated in FIG. 3 is for illustration only, and the UEs 111-115 of FIG. 1 could have the same or similar configuration. However, UEs come in a wide variety of configurations, and FIG. 3 does not limit the scope of this disclosure to any particular implementation of a UE.

As shown in FIG. 3, the UE 116 includes an antenna 305, a radio frequency (RF) transceiver 310, TX processing circuitry 315, a microphone 320, and receive (RX) processing circuitry 325. The UE 116 also includes a speaker 330, a processor 340, an input/output (I/O) interface (IF) 345, an input device 350, a display 355, and a memory 360. The memory 360 includes an operating system (OS) 361 and one or more applications 362.

The RF transceiver 310 receives, from the antenna 305, an incoming RF signal transmitted by an eNB of the network 100. In one embodiment, the antenna 305 may be implemented by a multi-aperture lens antenna system comprising multiple lenses and multi/single-source for wireless communications. In such embodiment, the lens aperture includes at least two different-type lenses, each of which is designed to achieve different angular range.

The RF transceiver 310 down-converts the incoming RF signal to generate an intermediate frequency (IF) or baseband signal. The IF or baseband signal is sent to the RX processing circuitry 325, which generates a processed baseband signal by filtering, decoding, and/or digitizing the baseband or IF signal. The RX processing circuitry 325 transmits the processed baseband signal to the speaker 330 (such as for voice data) or to the processor 340 for further processing (such as for web browsing data).

The TX processing circuitry 315 receives analog or digital voice data from the microphone 320 or other outgoing baseband data (such as web data, e-mail, or interactive video game data) from the processor 340. The TX processing circuitry 315 encodes, multiplexes, and/or digitizes the outgoing baseband data to generate a processed baseband or IF signal. The RF transceiver 310 receives the outgoing processed baseband or IF signal from the TX processing circuitry 315 and up-converts the baseband or IF signal to an RF signal that is transmitted via the antenna 305.

The processor 340 can include one or more processors or other processing devices and execute the OS 361 stored in the memory 360 in order to control the overall operation of the UE 116. For example, the processor 340 could control the reception of forward channel signals and the transmission of reverse channel signals by the RF transceiver 310, the RX processing circuitry 325, and the TX processing circuitry 315 in accordance with well-known principles. In some embodiments, the processor 340 includes at least one microprocessor or microcontroller.

The processor 340 is also capable of executing other processes and programs resident in the memory 360, such as processes for processing beam patterns and angular coverage of planar lens antenna systems by employing multiple lenses and feed arrays.

The processor 340 can move data into or out of the memory 360 as required by an executing process. In some embodiments, the processor 340 is configured to execute the applications 362 based on the OS 361 or in response to signals received from eNBs or an operator. The processor 340 is also coupled to the I/O interface 345, which provides the UE 116 with the ability to connect to other devices, such as laptop computers and handheld computers. The I/O interface 345 is the communication path between these accessories and the processor 340.

The processor 340 is also coupled to the input device 350 and the display 355. The operator of the UE 116 can use the input device 350 to enter data into the UE 116. The display 355 may be a liquid crystal display, light emitting diode display, or other display capable of rendering text and/or at least limited graphics, such as from web sites.

The memory 360 is coupled to the processor 340. Part of the memory 360 could include a random access memory (RAM), and another part of the memory 360 could include a Flash memory or other read-only memory (ROM).

Although FIG. 3 illustrates one example of UE 116, various changes may be made to FIG. 3. For example, various components in FIG. 3 could be combined, further subdivided, or omitted and additional components could be added according to particular needs. As a particular example, the processor 340 could be divided into multiple processors, such as one or more central processing units (CPUs) and one or more graphics processing units (GPUs). Also, while FIG. 3 illustrates the UE 116 configured as a mobile telephone or smartphone, UEs could be configured to operate as other types of mobile or stationary devices.

According to this disclosure, as illustrated in FIG. 2 and FIG. 3, antennas 205*a*-210*n* and 305 may form a beam steerable lens antenna system including multi-lens apertures that may enhance performance of the lens antenna system by employing multi-lens aperture. In such antenna system, beam patterns and angular coverage of the lens antenna systems may be enhanced by employing multiple lenses and feed arrays. In addition, the beam steerable lens antenna according to this disclosure may provide improved performance, functionality, and cost of millimeter wave communication systems that is used in 5th generation (5G) communication system, an IEEE802.1 lad communication system, WiGig, WiXLE, and WirelessHD systems.

More specifically, the planar lens antenna system using a single lens aperture with patch array feed may be used to enhance performance of the antenna system. In one embodiment, multi-aperture lens antenna system includes more than 1 lens that is used with at least 1 subarray. For example, such a system may include a plurality of lenses positioned proximate to antenna element(s) where each of the lenses is positioned in an aperture through which one or more of the antenna element(s) emits one or more beam. As used herein, a multi-aperture planar-lens antenna system may be used instead of "multi-aperture antenna system" or "multi-aperture planar antenna system."

Figure 4:
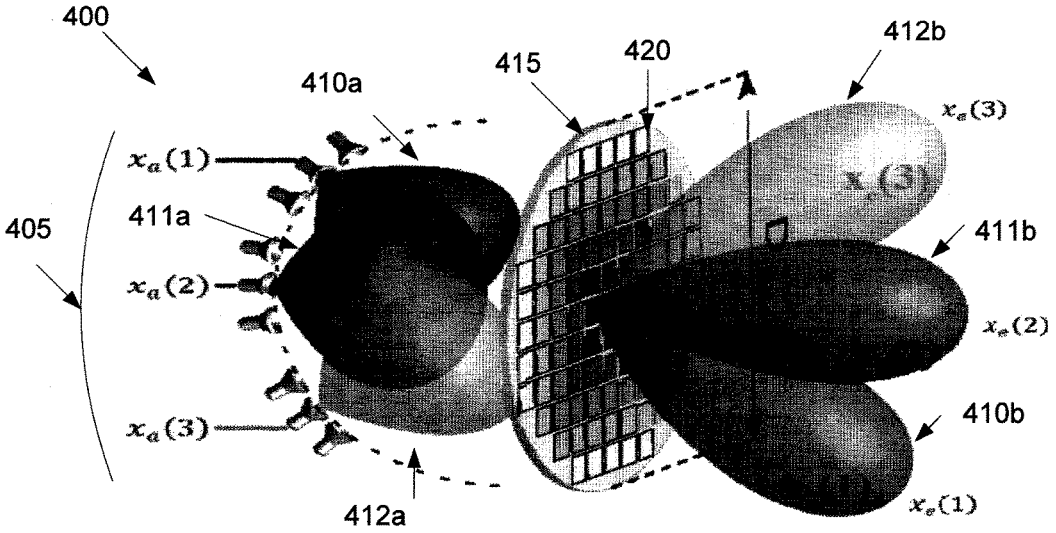
FIG. 4 illustrates an example planar lens antenna system according to this disclosure.

FIG. 4 illustrates an example planar lens antenna system 400 according to this disclosure. An embodiment of the planar lens antenna system 400 illustrated in FIG. 4 is for illustration only. Other embodiments may be used without departing from the scope of the present disclosure.

The planar lens antenna system 400 illustrated in FIG. 4 is implemented based on a single lens aperture fed by single or multiple sources. The planar lens antenna system 400 comprises metal patterns and substrate layers to provide a desirable phase variation through the lens structure.

As illustrated in FIG. 4, the planar lens antenna system 400 comprises a multi-subarray 405, an aperture 415, a set of patch elements 420, a set of antenna beam patterns 410*b*, 411*b*, 412*b*. More specifically, the multi-subarray 405 includes a set of subarrays providing multi-sources (such as beam 410*a*, 411*a*, 412*a*). For example, the beam 410*a* is provided from a subarray Xa(1). Similarly, the beam 411*a* and the beam 412*a* are provided from subarrays Xa(2) and Xa(3), respectively.

The aperture 415 includes the set of patch elements 420. In one embodiment, the set of patch elements 420 is implemented as a rectangular shape as illustrated in FIG. 4. In another embodiment, the set of patch elements 420 is implemented as an elliptical shape, a triangular shape, or any type of shape. The beams 410*a*, 411*a*, 412*a* are emitted as the beams 410*b*, 411*b*, 412*b* to receiver systems through the aperture 415. For example, the beam 412*b* is emitted from the planar lens antenna system 400 in accordance with the beam 412*a* provided from Xa(3). Similarly, the beam 410*b* and 411*b* are emitted from the planar lens antenna system 400 in accordance with the beams 410*a* and 411*a*, respectively.

The aperture 415 comprises the set of patch elements 420 to emit an input beam (such as 410*a*, 411*a*, 412*a*). In one embodiment, the aperture 415 is implemented as a single-aperture having a single phase profile (such as single type of lens). In another embodiment, the aperture 415 is implemented as multi-aperture having different phase profiles (such as multi-type of lenses). In such embodiment, each of lenses is designed to have different phase profile to emit the input beams (such as 410*a*, 411 *a*, 412*a*) provided from the subarrays 405. Accordingly, the emitted beam patterns (such as 410*b*, 411*b*, 412*b*) through different lenses (such as the aperture 415, multi-aperture) have different beam patterns (such as wider, narrower, shorter and/or longer shape).

Figure 5:
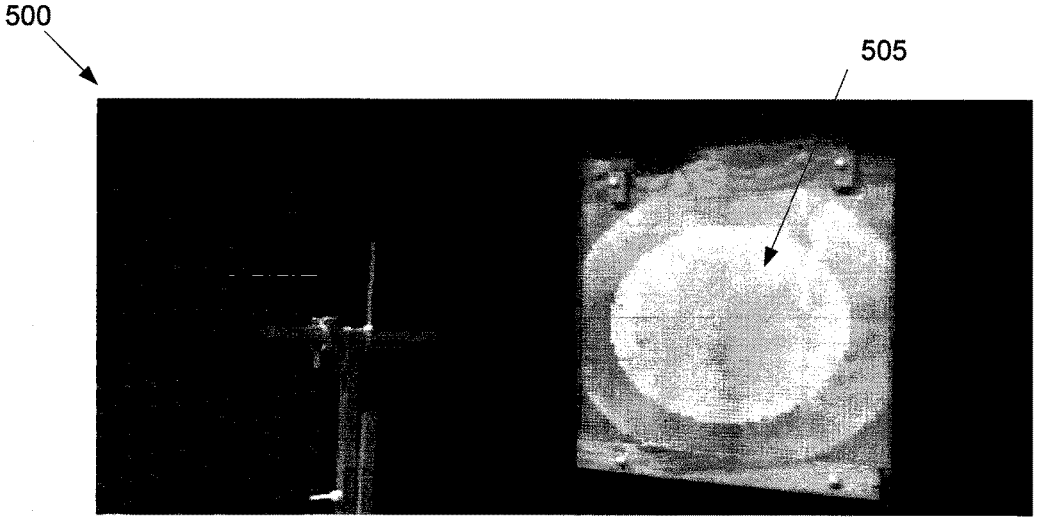
FIG. 5 illustrates an example distribution of a set of metal patch elements of planar lens antenna system according to this disclosure.

FIG. 5 illustrates an example distribution of a set of metal patch elements of planar lens antenna system 500 according to this disclosure. An embodiment of the distribution of the set of metal patch elements of planar lens antenna system 500 illustrated in FIG. 5 is for illustration only. Other embodiments may be used without departing from the scope of the present disclosure.

As illustrated in FIG. 5, a distribution of a set of metal patch elements 505 (such as 420 as illustrated in FIG. 4) renders a concentric shape having a center point. The configuration illustrated in FIG. 5 employing a single lens aperture that may be detected by a single center point of the distribution of the set of metal patch elements 505, suffers from limited beam steering capability and narrow angular coverage. In one embodiment, a distribution of the set of metal patch elements 505 in a plurality of lenses renders at least two concentric circles that configure the multi-aperture lens antenna system. In such embodiment, the multi-aperture lens antenna system is configured by multiple center points of the distribution of the set of metal patch elements 505.

Figure 6:
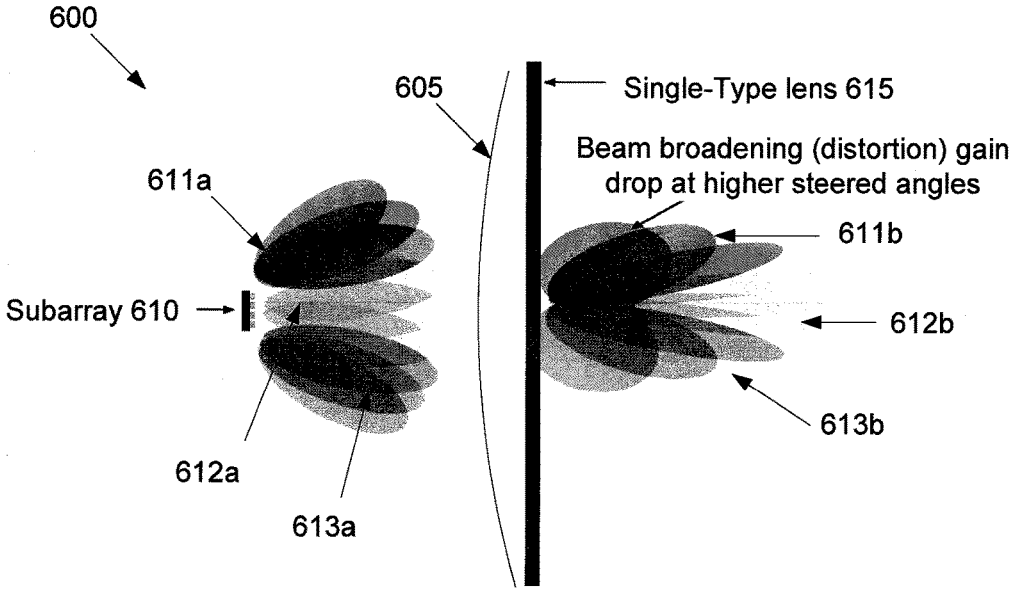
FIG. 6 illustrates an example beam steering of single-aperture single-source planar lens antenna system according to this disclosure.

FIG. 6 illustrates an example beam steering of single-aperture single-source planar lens antenna system 600 according to this disclosure. An embodiment of the beam steering of single-aperture single/multi-source planar lens antenna system 600 illustrated in FIG. 6 is for illustration only. Other embodiments may be used without departing from the scope of the present disclosure.

As illustrated in FIG. 6, the single-aperture single-source planar lens antenna system 600 comprises a single aperture 605 and a subarray 610. The subarray 610 provides single source that includes similar antenna beam patterns 611*a*, 612*a*, 613*a*. The single-aperture 605 comprises a single type of lens 615 that radiates various beam patterns 611*b*, 612*b*, 613*b* through the single-aperture 605. The beam patterns 611*b*, 612*b*, 613*b* are radiated as a function of steered angles. As the steering angle becomes higher, a radiation pattern becomes broader with a gain drop. Accordingly, angular coverages of each beam (such as 611*b*, 612*b*, 613*b*) are overlapped. As a result, the original angular scan range of feed subarray decreases after mounting a lens (such as 605) in front of the subarray 610.

Figure 7:
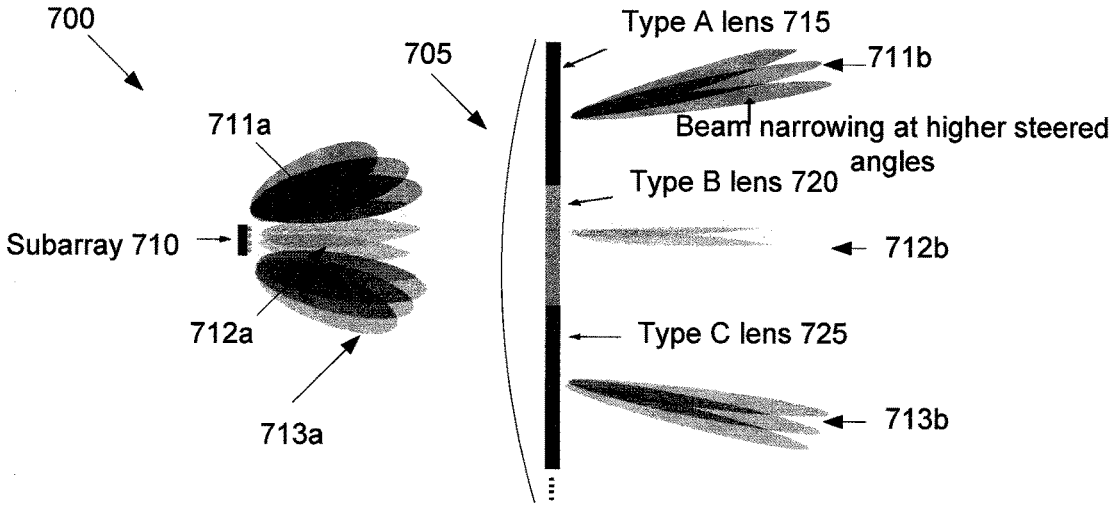
FIG. 7 illustrates an example beam steering of multi-aperture single-source lens antenna system according to this disclosure.

FIG. 7 illustrates an example beam steering of multi-aperture single-source lens antenna system 700 according to this disclosure. An embodiment of the beam steering of multi-aperture single-source lens antenna system 700 illustrated in FIG. 7 is for illustration only. Other embodiments may be used without departing from the scope of the present disclosure.

As illustrated in FIG. 7, the multi-aperture single-source lens antenna system 700 comprises a multi-aperture 705 and a subarray 710. The subarray 710 provides single source that includes similar antenna beam patterns 711*a*, 712*a*, 713*a*. The multi-aperture 705 comprises a multiple types of lenses (such as type A lens 715, type B lens 720, type C lens 725) that radiate various beam patterns 711*b*, 712*b*, 713*b* through the multi-aperture 705. The beam patterns 711*b*, 712*b*, 713*b* are radiated as a function of steered angles. As the steering angle becomes higher, a radiation pattern becomes narrower. Accordingly, angular coverages of each beam (such as 711*b*, 712*b*, 713*b*) are not overlapped.

As illustrated in FIG. 7, the multi-aperture 705 includes at least two different-types of lenses, each of which is designed to achieve different angular range. Angular coverages of type A lens, type B lens, and type C lens are not overlapped. The different angular ranges (such as 711*b*, 712*b*, 713*b*) of the multi-aperture 705 can be realized by employing different types of lenses (such as type A lens 715, type B lens 720, type C lens 725) having different phase profiles appropriately chosen based on relative positions of the multiples lenses to the subarray 710.

Figure 8:
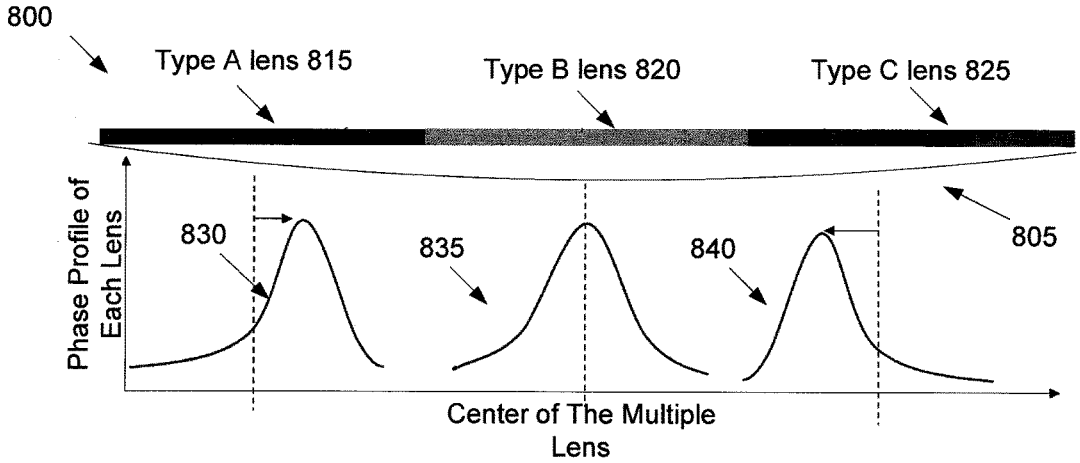
FIG. 8 illustrates an example phase profile of different-type lenses according to this disclosure.

FIG. 8 illustrates an example phase profiles of different-type lenses 800 according to this disclosure. An embodiment of the phase profiles of different-type lenses 800 illustrated in FIG. 8 is for illustration only. Other embodiments may be used without departing from the scope of the present disclosure.

As illustrated in FIG. 8, A multi-aperture 805 includes multiple lenses (such as type A lens 815, type B lens 820, type C lens 825) having different types of phase profile that has different distributions 830, 835, 840, respectively. For example, the type A lens 815 has the phase profile 830, the type B lens 820 has the phase profile 835, and the type C lens has the phase profile 840. As illustrated in FIG. 8, the phase profile 835 of the type B lens 820 is located on the center of the type B lens 820. In contrast, the phase profile 830 of the type A lens 815 is shifted into the right side and the phase profile 840 of the type C lens 825 is shifted into the left side to compensate a phase spread causing a gain drop at highly steered angles.

Figure 9:
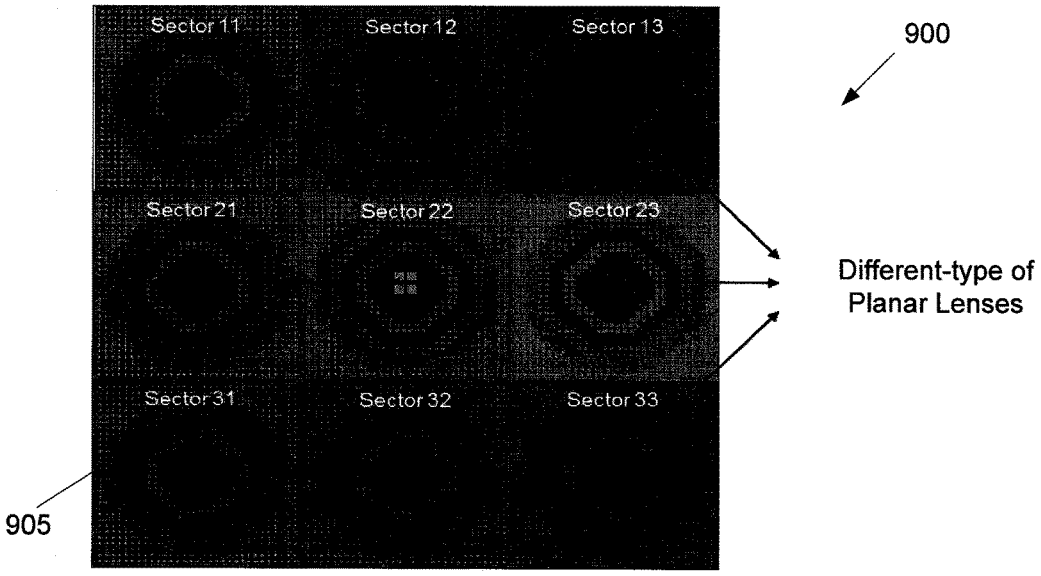
FIG. 9 illustrates an example top view of multi-aperture single-source lens antenna system according to this disclosure.

FIG. 9 illustrates an example top view of multi-aperture single-source lens antenna system 900 according to this disclosure. An embodiment of the top view of multi-aperture single-source lens antenna system 900 illustrated in FIG. 9 is for illustration only. Other embodiments may be used without departing from the scope of the present disclosure.

As illustrated in FIG. 9, the multi-aperture single-source lens antenna system 900 includes a set of different sectors (such as 3×3 sector including 9 sectors), each of which has a different phase profile (such as 830, 835, 840 as illustrated in FIG. 8) to cover different angular range of beam steering. For example, the multi-aperture single-source lens antenna system 700 as illustrated in FIG. 7 includes a single-source 905 located in the sector 22. Accordingly, the single-source 905 is radiated through different-type of planar lenses.

Figure 10:
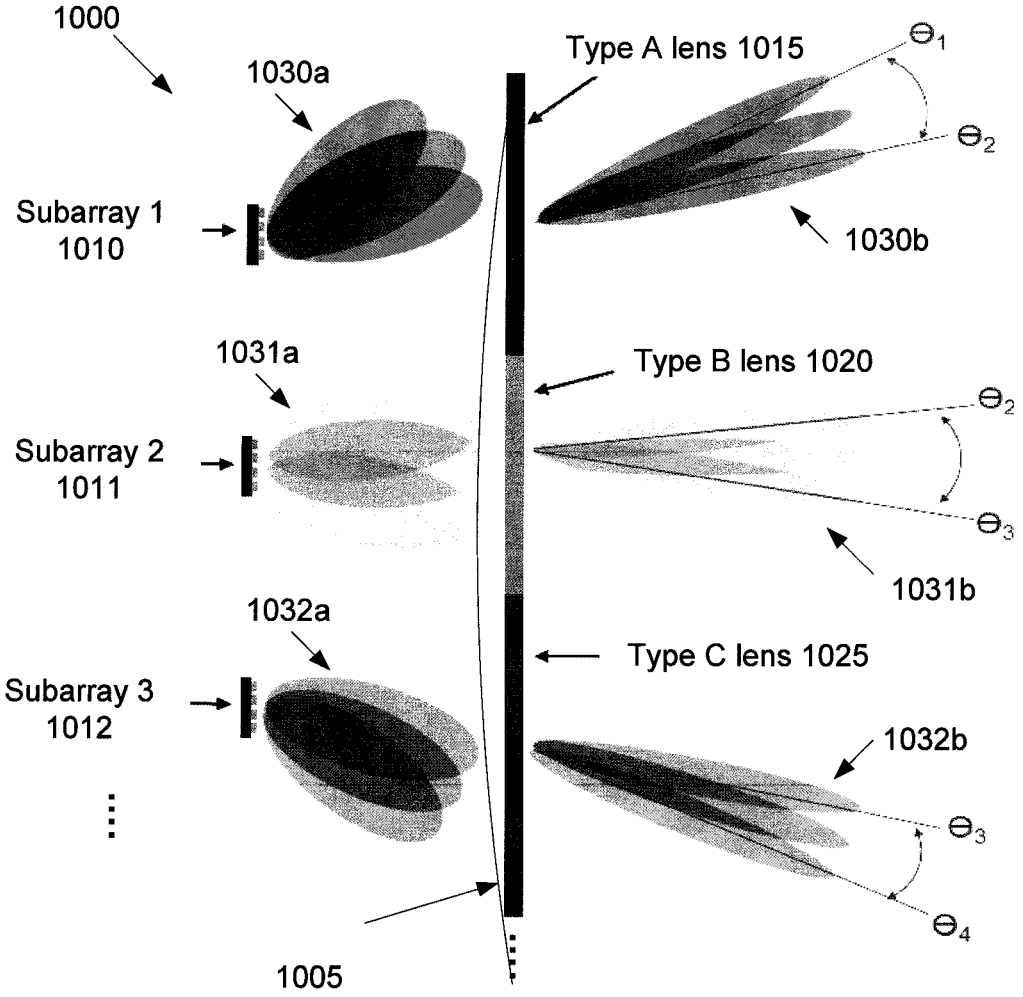
FIG. 10 illustrates an example beam steering of multi-aperture multi-source lens antenna system according to this disclosure.

FIG. 10 illustrates an example beam steering of multi-aperture multi-source lens antenna system 1000 according to this disclosure. An embodiment of beam steering of multi-aperture multi-source lens antenna system 1000 illustrated in FIG. 10 is for illustration only. Other embodiments may be used without departing from the scope of the present disclosure.

As illustrated in FIG. 10, the multi-aperture multi-source lens antenna system 1000 comprises a multi-aperture 1005, a set of subarrays 1010, 1011, 1012, a set of different types of lens 1015 (such as type A lens), 1020 (such as type A lens), 1025 (such as type A lens). The set of subarrays 1010, 1011, 1012 provide multiple sources that include similar antenna beam patterns 1030*a*, 1031*a*, 1032*a*. The multi-aperture 1005 comprises a multiple types of lenses (such as type A lens 1015, type B lens 1020, type C lens 1025) that radiate various beam patterns 1030*b*, 1031*b*, 1032*b* through the multi-aperture 1005. The beam patterns 1030*b*, 1031*b*, 1032*b* are radiated as a function of steered angles.

The multi-aperture 1005 can be fed by multiple sources configured by the set of subarrays 1010, 1011, 1012 as illustrated in FIG. 10. The multi-aperture multi-source lens antenna system 1000 has a great advantage for a low profile lens antenna system employing a single-source. In one embodiment, a center of a lens in a single-source fed lens antenna system is positioned near the end of the whole lens structure. In such embodiment, the center of the lens becomes too far from the single-source and thus a spill-over efficiency becomes quite low. In another embodiment, a multi-source can compensate different path lengths due to a single-source.

As illustrated in FIG. 10, the multi-aperture multi-source lens antenna system 1000 includes different types of lenses (such as type A lens 1015, type B lens 1020, type C lens 1025), each of which is designed to minimize interference among the multi-beams 1030*b*, 1031*b*, 1032*b* emitted from more than one subarrays 1010, 1011, 1012. For example, the subarray 1 1010 provides the beam 1030*a* and emits the beam 1030*b* through the multi-aperture 1005. Similarly, the subarray 2 1011 provides the beam 1031*a* and emits the beam 1031*b* through the multi-aperture 1005, and the sub-array 3 1012 provides the beam 1032*a* and emits the beam 1032*b* through the multi-aperture 1005.

Figure 11:
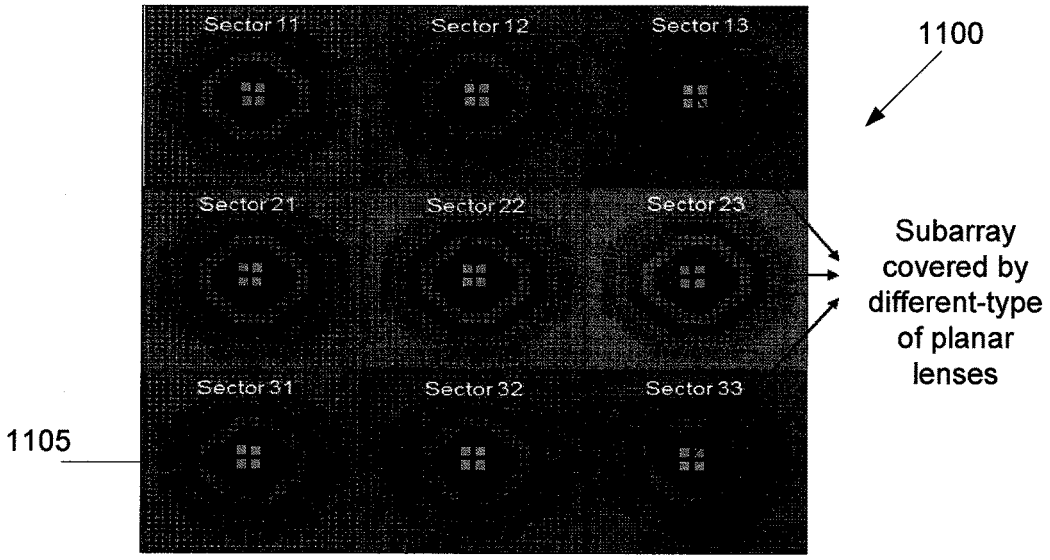
FIG. 11 illustrates an example top view of multi-aperture multi-source planar lens antenna system according to this disclosure.

FIG. 11 illustrates an example top view of multi-aperture multi-source planar lens antenna system 1100 according to this disclosure. An embodiment of the top view of multi-aperture multi-source lens antenna system 1100 illustrated in FIG. 11 is for illustration only. Other embodiments may be used without departing from the scope of the present disclosure.

As illustrated in FIG. 11, the multi-aperture multi-source lens antenna system 1100 includes a set of different sectors (such as 3×3 sector including 9 sectors), each of which has a different phase profile (such as 830, 835, 840 as illustrated in FIG. 8) to cover different angular ranges of beam steering.

For example, the multi-aperture multi-source lens antenna system 1000 illustrated in FIG. 10 includes a set of single-sources 1105 (such as multi-source) located in all the sectors (such as sector 11, 12, 13, 21, 22, 23, 31, 32, 33). Accordingly, the multi-source is radiated through different-types of planar lenses.

In some embodiments, a multi-aperture lens antenna system where one lens is fed by more than one subarrays can improve beam steering capability for highly steered angles and a freedom of design in controlling beam resolution and interference.

Figure 12:
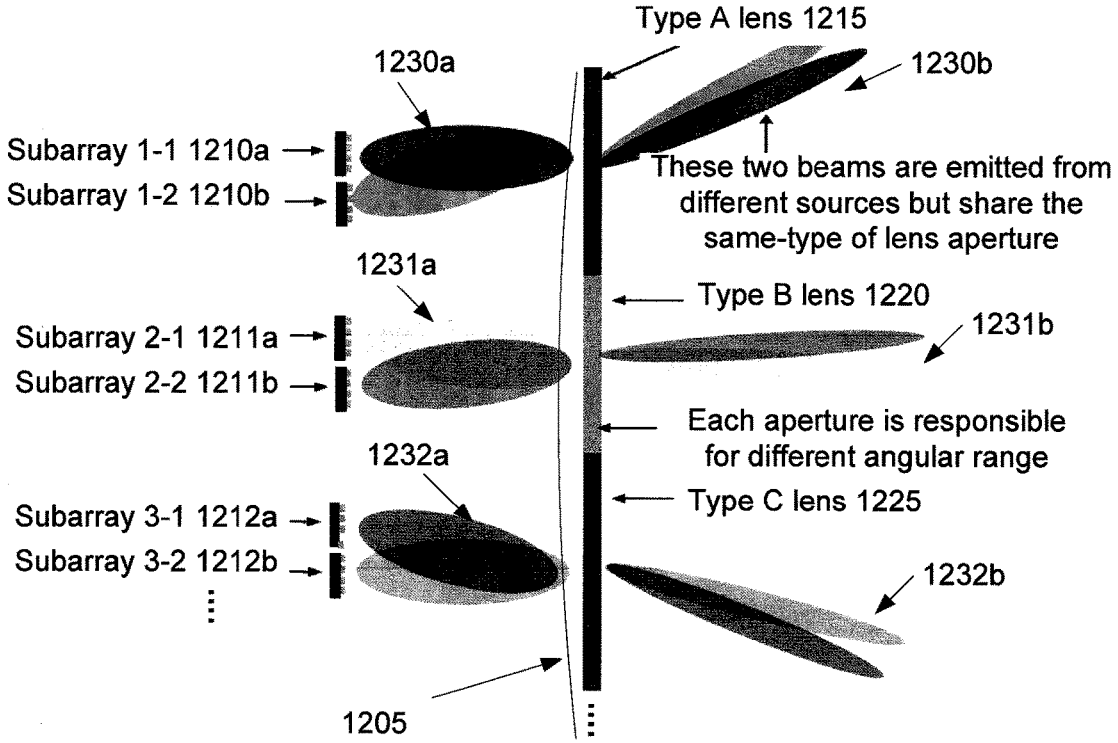
FIG. 12 illustrates another example beam steering of multi-aperture multi-source lens antenna system according to this disclosure.

FIG. 12 illustrates another example beam steering of multi-aperture multi-source lens antenna system 1200 according to this disclosure. An embodiment of beam steering of multi-aperture multi-source lens antenna system 1200 illustrated in FIG. 12 is for illustration only. Other embodiments may be used without departing from the scope of the present disclosure.

As illustrated in FIG. 12, the multi-aperture multi-source lens antenna system 1200 comprises a multi-aperture 1205, a set of subarrays 1210*a* (such as subarray 1-1), 1210*b* (such as subarray 1-2), 1211*a* (such as subarray 2-1), 1211*b* (such as subarray 2-2), 1212*a* (such as subarray 3-1), 1212*b* (such as subarray 3-2), and a set of different types of lens 1215 (such as type A lens), 1220 (such as type B lens), 1225 (such as type C lens). The set of subarrays 1210*a*, 1210*b*, 1211*a*, 1211*b*, 1212*a*, 1212*b* emit similar antenna beam patterns 1230*a*, 1231*a*, 1232*a*. The multi-aperture 1205 comprises a multiple types of lenses (such as type A lens 1215, type B lens 1220, type C lens 1225) that radiate various beam patterns 1230*b*, 1231*b*, 1232*b* through the multi-aperture 1205. The beam patterns 1230*b*, 1231*b*, 1232*b* are radiated as a function of steered angles. The multiple-aperture 1205 can be fed by multiple sources configured by the set of subarrays 1210*a*, 1210*b*, 1211*a*, 1211*b*, 1212*a*, 1212*b* as illustrated in FIG. 12.

As illustrated in FIG. 12, the multi-aperture multi-source lens antenna system 1200 includes different types of lenses (such as type A lens 1215, type B lens 1220, type C lens 1225), each of which is designed to minimize interference among the multi-beams 1230*b*, 1231*b*, 1232*b* emitted from more than one subarrays 1210*a*, 1210*b*, 1211*a*, 1211*b*, 1212*a*, 1212*b*. For example, the subarrays 1-1 1210*a* and 1-2 1210*b* emit the beam 1230*a* and the beam 1230*b* through the multi-aperture 1205. Similarly, the subarrays 2-1 1211*a* and 2-2 1211*b* emit the beam 1231*a* and emits the beam 1231*b* through the multi-aperture 1005, and the subarrays 3-1 1212*a* and 3-2 1212*b* emit the beam 1232*a* and emits the beam 1232*b* through the multi-aperture 1205.

More specifically, the beam 1230*b* includes two sub-beams that are emitted from different sources (such as through the subarray 1-1 and 1-2), but the beam 1230*b* shares the same-type of lens aperture (such as 1205). Similarly, the beam 1231*b* includes two sub-beams that are emitted from different sources (such as through the subarray 2-1 and 2-2), but the beam 1231*b* shares the same-type of lens aperture (such as 1205), and the beam 1232*b* includes two sub-beams that are emitted from different sources (such as through the subarray 3-1 and 3-2), but the beam 1232*b* shares the same-type of lens aperture (such as 1205). As illustrated in FIG. 12, each aperture of the multi-aperture 1205 is responsible for different angular ranges of the beams 1230*b*, 1231*b*, 1232*b*.

Figure 13:
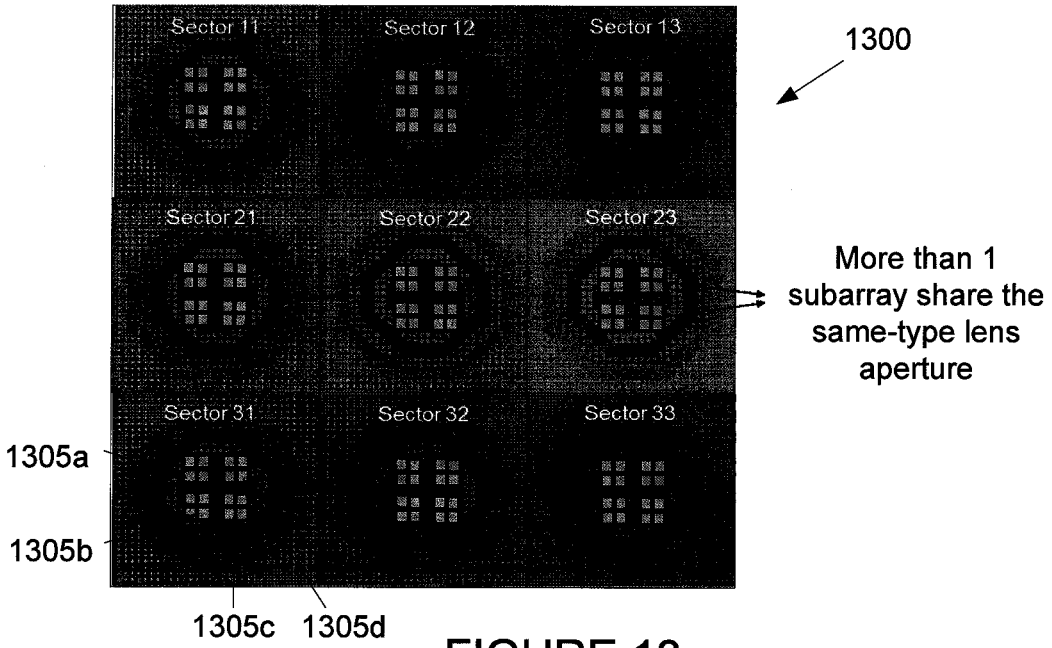
FIG. 13 illustrates another example top view of multi-aperture multi-source lens antenna system according to this disclosure.

FIG. 13 illustrates another example top view of multi-aperture multi-source lens antenna system 1300 according to this disclosure. An embodiment of the top view of multi-aperture multi-source lens antenna system 1300 illustrated in FIG. 13 is for illustration only. Other embodiments may be used without departing from the scope of the present disclosure.

As illustrated in FIG. 13, the multi-aperture multi-source lens antenna system 1300 includes a set of different sectors (such as 3×3 sector including 9 sectors), each of which has a different phase profile (such as 830, 835, 840 as illustrated in FIG. 8) to cover different angular ranges of beam steering. More specifically, FIG. 13 shows the multi-aperture multi-source lens antenna system 1300 including more than 1 subarray that share the same-type lens aperture. Accordingly, each of sectors (such as sector 11, 12, 13, 21, 22, 23, 31, 32, and 33) includes multi-sources 1305*a*, 1305*b*, 1305*c*, 1305*d* provided from more than 1 subarrays (such as subarray 1-1 and 1-2 illustrated in FIG. 12).

Figure 14:
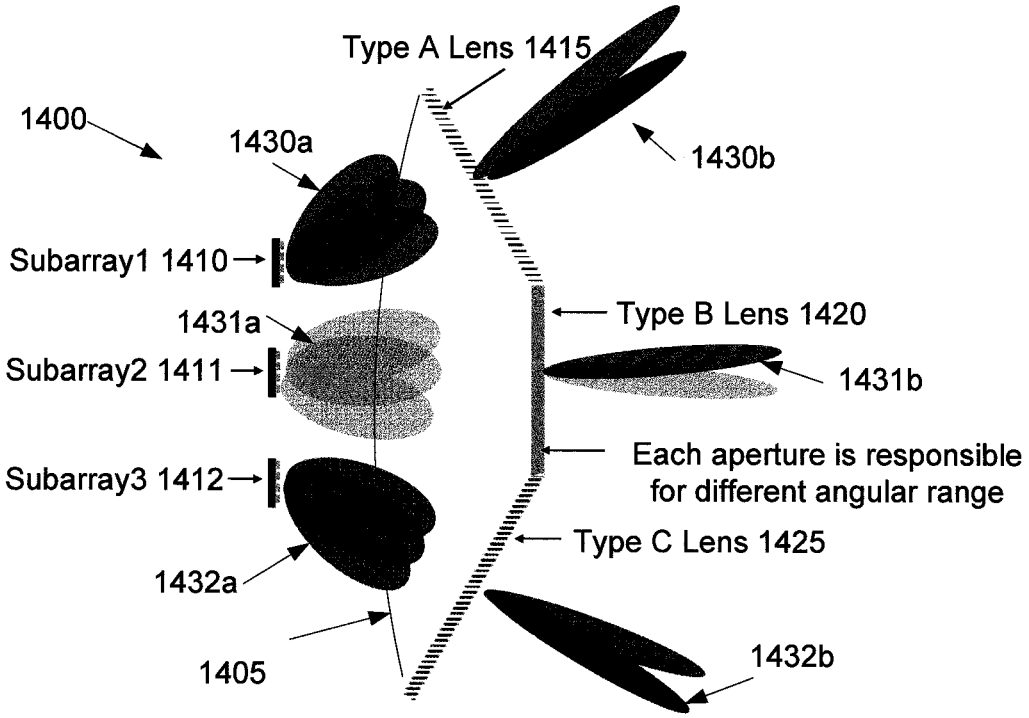
FIG. 14 illustrates an example beam steering of multi-aperture multi-source curved 3 dimensional (D) lens antenna system according to this disclosure.

FIG. 14 illustrates an example beam steering of multi-aperture multi-source curved 3 dimensional (D) lens antenna system 1400 according to this disclosure. An embodiment of beam steering of multi-aperture multi-source curved 3D lens antenna system 1400 illustrated in FIG. 14 is for illustration only. Other embodiments may be used without departing from the scope of the present disclosure.

As illustrated in FIG. 14, the multi-aperture multi-source curved 3D lens antenna system 1400 (such as curved 3D configuration) comprises a multi-aperture 1405, a set of subarrays 1410, 1411, 1412, and a set of different types of lens 1415 (such as type A lens), 1420 (such as type B lens), 1425 (such as type C lens). The set of subarrays 1410, 1411, 1412 emit similar antenna beam patterns 1430*a*, 1431*a*, 1432*a*. The multi-aperture 1405 comprises a multiple types of lenses (such as type A lens 1415, type B lens 1420, type C lens 1425) that radiate various beam patterns 1430*b*, 1431*b*, 1432*b* through the multi-aperture 1405. The beam patterns 1430*b*, 1431*b*, 1432*b* are radiated as a function of steered angles. The multiple-aperture 1405 can be fed by multiple sources configured by the set of subarrays 1410, 1411, 1412 as illustrated in FIG. 14.

As illustrated in FIG. 14, the multi-aperture multi-source curved 3D lens antenna system 1400 includes different types of lenses (such as type A lens 1415, type B lens 1420, type C lens 1425), each of which is designed to minimize interference among the multi-beams 1430*b*, 1431*b*, 1432*b* emitted from more than one subarrays 1410, 1411, 1412. For example, the subarrays 1410 emits the beam 1430*a* through the curved 3D multi-aperture 1405. Similarly, the subarrays 1411 emits the beam 1431*a* through the curved 3D multi-aperture 1405, and the subarrays 1412 emits the beam 1432*b* through the curved 3D multi-aperture 1405.

As illustrated in FIG. 14, each aperture of the multi-aperture 1405 is responsible for different angular ranges of the beams 1430*b*, 1431*b*, 1432*b*.

Figure 15:
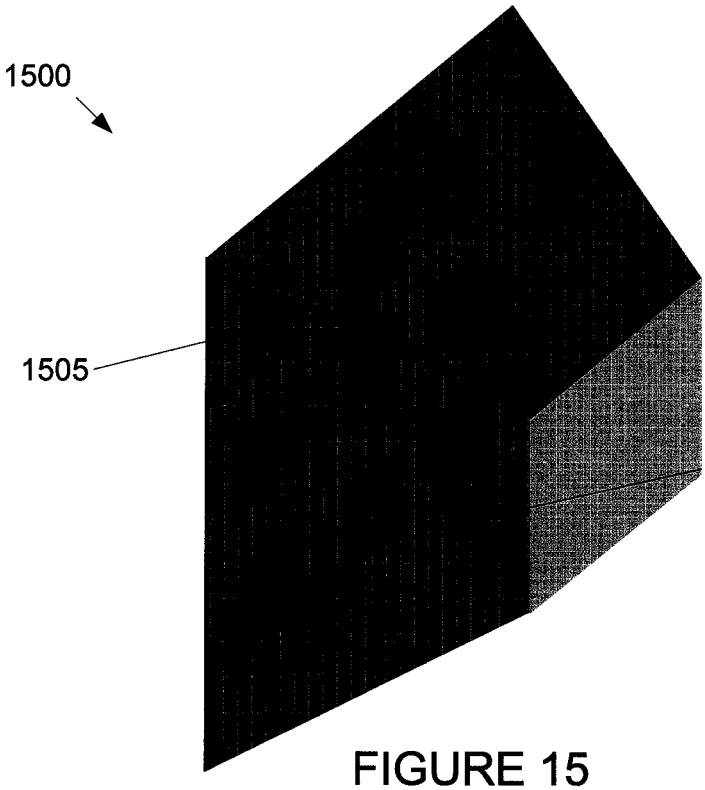
FIG. 15 illustrates an example view of multi-aperture multi-source curved 3D lens antenna system according to this disclosure.

FIG. 15 illustrates an example view of multi-aperture multi-source curved 3D lens antenna system 1500 according to this disclosure. An embodiment of beam steering of multi-aperture multi-source curved 3D lens antenna system 1500 illustrated in FIG. 15 is for illustration only. Other embodiments may be used without departing from the scope of the present disclosure.

As illustrated in FIG. 15, the multi-aperture multi-source curved 3D lens antenna system 1500 includes a set of different sectors 1505 (such as 3×3 sector including 9 sectors), each of which has a different phase profile (such as 830, 835, 840 as illustrated in FIG. 8) to cover different angular ranges of beam steering. More specifically, FIG. 15 shows the multi-aperture multi-source curved 3D lens antenna system 1500 including more than 1 subarray that share the same-type lens aperture. Accordingly, each of different sectors 1505 includes multi-sources provided from more than 1 subarrays (such as subarrays 1, 2, and 3 illustrated in FIG. 14).

Figure 16:
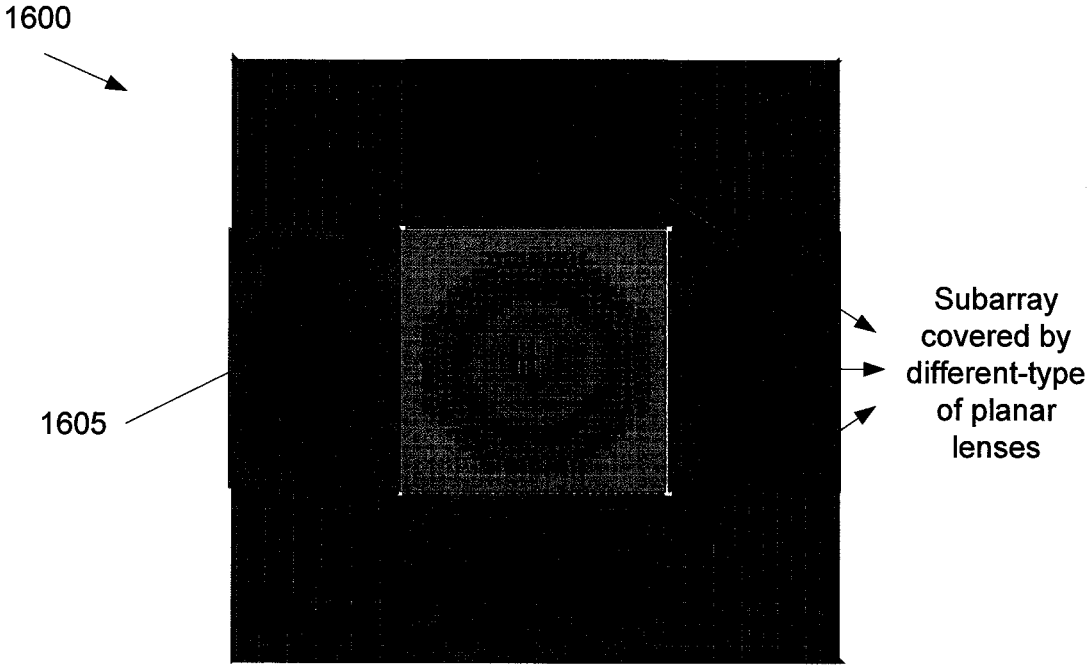
FIG. 16 illustrates an example top view of multi-aperture multi-source curved 3D lens antenna system according to this disclosure.

FIG. 16 illustrates an example top view of multi-aperture multi-source curved 3D lens antenna system according to this disclosure. An embodiment of the top view of the multi-aperture multi-source curved 3D lens antenna system 1600 illustrated in FIG. 16 is for illustration only. Other embodiments may be used without departing from the scope of the present disclosure.

As illustrated in FIG. 16, the multi-aperture multi-source curved 3D lens antenna system 1600 includes a set of different sectors 1605, each of which has a different phase profile (such as 830, 835, 840 as illustrated in FIG. 8) to cover different angular ranges of beam steering. More specifically, FIG. 16 shows the multi-aperture multi-source lens antenna system 1600 including more than 1 subarray that share the same-type lens aperture. Accordingly, each of sectors 1605 includes multi-sources provided from more than 1 subarrays (such as subarrays 1, 2, and 3 illustrated in FIG. 14).

In some embodiments, multi-lens aperture single/multi-source antenna system including at least one lens sector that has a different phase profile than the others enables a wider angular coverage of beam steering and multiple beam radiation. In such embodiment, the multi-aperture single/multi-source antenna system may be used for an access network system requiring a wider scanning range.

In some embodiments, a multi-aperture lens antenna system is implemented using different types of lenses, for example, a conformal dielectric lens, a hybrid lens and a Fresnel lenses fed by a flat feed plane. In such embodiments, different types of lenses may be implemented as a curved 3D configuration (e.g., multi-aperture curved 3D lens antenna system, such as illustrated, for example, in FIGS. 7-13) and/or a planar configuration (e.g., multi-aperture planar lens antenna system, such as illustrated, for example, in FIGS. 14-16). In addition, various combinations of multiple types of lenses may be implemented on the multi-aperture curved 3D lens antenna system.

In some embodiments, while patch elements in a subarray is presented as a square-shape, a feed subarray configuration is applied for a combination of diverse-shape and type feed elements. In such embodiments, a shape of the patch elements may be a rectangular shape, an elliptical shape, a triangular shape, etc. In addition, the feed antenna (such as subarray) may be any type of antenna (such as patch, dipole, horn, etc.).

In some embodiments, a multi-aperture lens antenna system is extended for other beam shaping purpose such as beam broadening.

In some embodiments, a multi-aperture lens antenna system is fabricated and integrated with various platforms without strict requirements for a fabrication process such as a printed circuit board (PCB) process and a complementary metal-oxide semiconductor (CMOS) process.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. An apparatus comprising:

at least one feed subarray of antenna elements configured to emit a plurality of beams; and a plurality of planar lenses configured to steer the plurality of beams, each planar lens of the plurality of planar lenses including a different phase profile and positioned adjacent to another one of the plurality of planar lenses.

2. The apparatus of claim 1, wherein each planar lens of the plurality of planar lenses includes a set of metal patch elements that render at least two concentric circles.

3. The apparatus of claim 1, wherein a number of the feed subarrays of antenna elements is less than a number of the plurality of planar lenses.

4. The apparatus of claim 1, wherein a number of the feed subarrays of antenna elements is greater than a number of the plurality of planar lenses.

5. The apparatus of claim 1, wherein a number of the feed subarrays of antenna elements is equal to a number of the plurality of planar lenses.

6. The apparatus of claim 1, wherein the plurality of planar lenses are positioned in a planar configuration.

7. The apparatus of claim 1, wherein the plurality of planar lenses are positioned in a curved three dimensional configuration.

8. A method for operating a system, the method comprising:

emitting, using at least one feed subarray of antenna elements, a plurality of beams; and steering, using a plurality of planar lenses, the plurality of beams, each planar lens of the plurality of planar lenses including a different phase profile and positioned adjacent to another one of the plurality of planar lenses.

9. The method of claim 8, wherein each planar lens of the plurality of planar lenses includes a set of metal patch elements that render at least two concentric circles.

10. The method of claim 8, wherein a number of the feed subarrays of antenna elements is less than a number of the plurality of planar lenses.

11. The method of claim 8, wherein a number of the feed subarrays is greater than a number of the plurality of planar lenses.

12. The method of claim 8, wherein a number of the feed subarrays is equal to a number of the plurality of planar lenses.

13. The method of claim 8, wherein the plurality of planar lenses are positioned in a planar configuration.

14. The method of claim 8, wherein the plurality of planar lenses are positioned in a curved three dimensional configuration.

15. A wireless communication device:

a transceiver configured to provide one or more signals to an antenna system; and the antenna system including:

at least one feed subarray of antenna elements configured to emit a plurality of beams; and a plurality of planar lenses configured to steer the plurality of beams, each planar lens of the plurality of planar lenses including a different phase profile and positioned adjacent to one of the plurality of planar lenses, wherein each beam of the plurality of beams comprises a different beam pattern.

16. The wireless communication device of claim 15, wherein a number of the feed subarrays of antenna elements is less than a number of the plurality of planar lenses.

17. The wireless communication device of claim 15, wherein a number of the feed subarrays is equal to a number of the plurality of planar lenses.

18. The wireless communication device of claim 15, wherein the plurality of planar lenses are positioned in a planar configuration.

19. The wireless communication device of claim 15, wherein the plurality of planar lenses are positioned in a curved three dimensional configuration.

20. The wireless communication device of claim 15, wherein each planar lens of the plurality of planar lenses includes a set of metal patch elements that render at least two concentric circles.

* * * * *